US007083465B2

(12) United States Patent
Wu

(10) Patent No.: US 7,083,465 B2
(45) Date of Patent: Aug. 1, 2006

(54) SERIAL ATA INTERFACE CONNECTOR WITH LOW PROFILED CABLE CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/964,458

(22) Filed: Oct. 12, 2004

(65) Prior Publication Data

US 2006/0079119 A1 Apr. 13, 2006

(51) Int. Cl.
*H01R 12/24* (2006.01)

(52) U.S. Cl. ..... 439/497; 439/460

(58) Field of Classification Search ..... 439/497, 439/638, 579, 564, 492
See application file for complete search history.

(56) References Cited

U.S. PATENT DOCUMENTS 6,024,607 A * 2/2000 Wahl ..... 439/639
6,129,594 A * 10/2000 Lai ..... 439/701
6,494,749 B1 * 12/2002 Chang ..... 439/701
6,623,299 B1 * 9/2003 Liu ..... 439/604
6,648,668 B1 11/2003 Ko
6,648,676 B1 * 11/2003 Lee ..... 439/499
6,695,641 B1 2/2004 Lee
6,719,591 B1 * 4/2004 Chang ..... 439/638
6,758,694 B1 * 7/2004 Liu ..... 439/606
2004/0242064 A1 * 12/2004 Chang et al. ..... 439/564

* cited by examiner

*Primary Examiner*—Hae Moon Hyeon
(74) *Attorney, Agent, or Firm*—Wei Te Chung

(57) ABSTRACT

A cable assembly (1) includes a first connector (100), a second connector (200) and a cable set (300) connected with the first and second connectors. The first connector includes a first housing (11) and a plurality of signal and power contacts (12, 13) respectively mounted in the first housing. The second connector includes a second housing (21) and a plurality of signal and power terminals (22) respectively mounted in the second housing. The cable set includes a signal cable (31) and a plurality of power wires (32). The signal cable connects with the signal contacts of the first connector and terminated to the signal terminals of the second connector, while the power wires respectively connect with the power contacts of the first connector and terminated to the power terminals of the second connector. The first connector remains some power contacts free from any connection.

20 Claims, 8 Drawing Sheets

SERIAL ATA INTERFACE CONNECTOR WITH LOW PROFILED CABLE CONNECTOR

BACKGROUND OF THE INVENTION

1. Field of the Invention

The present invention relates to a cable assembly, and particularly to a Serial Advanced Technology Attachment (serial ATA) interface connector with a low profiled cable connector that provides a relay connection between internal devices of a notebook computer.

2. Description of the Prior Art

In the last decade, portable electronic devices, such as notebook computers have become essential tools for people relied upon facility. As the time goes by, the popularity of these devices has risen as the cost and the sizes of the devices have diminished. Currently, most notebook computers have storage devices called hard disk drives. The hard disk drive is connected to the main printed circuit board (PCB) of the notebook computer by way of an interface, usually a controller card, a cable, and some software protocols. One type of hard disk drive interface used today is an advanced technology attachment (ATA) interface which is a parallel interface whereby multiple bits of data are transmitted per time across the interface simultaneously during each transfer. A parallel interface allows for high throughput, however, as the frequency of the interface is increased, signaling problems and interference between signals become common.

Serial ATA is an interface specification that abandons the parallel concept in favor of a serial interface where only one bit is transferred per time. This allows the interface to operate at higher speed without the problems associated with a parallel interface at higher speed. The serial ATA interface also has some other improvements comparing with the parallel ATA interface, such as low cost, low pin count, and low voltage requirement, and so on. In a word, the serial ATA connector provides a long-term solution for high performance, and easier, more flexible system design.

U.S. Pat. No. 6,719,591 B1 issued to Chang discloses a serial ATA interface assembly performing high-speed transmission. The serial ATA interface assembly has a serial ATA interface connector comprising a signal section and a power supply section complying with the serial ATA interface pin assignment. The signal section is coupled to a signal cable on one side and terminated to a signal connector on one end for connecting to signals of a main PCB of a computer, while the power supply section is coupled to a power cable on the other side and terminated to at least one power input connector on the other end for supplying direct current power to an connecting device. As mentioned above, the serial ATA interface assembly has expected function of stable high-speed transmission. However, with the miniaturization and dense trend of the computer, especially of the notebook computer, it is desired that the serial ATA interface assembly, which provides a relay connection between the connecting device and the main PCB, could be as small as possible for reducing its occupying space in valuable internal space of the computer, especially reducing its layout space on the main PCB.

Hence, an improved serial ATA interface assembly is desired to overcome the disadvantages of the prior art.

BRIEF SUMMARY OF THE INVENTION

Therefore, a main object of the present invention is to provide a serial ATA interface connector with a low profiled cable connector that provides a relay connection between internal devices of a notebook computer.

In order to implement the main object and overcome the above-identified deficiencies in the prior art, the cable assembly in accordance with the present invention comprises a first connector, a second connector and a cable set connected with the first and second connectors. The first connector includes a first housing and a plurality of signal and power contacts respectively mounted in the first housing. The second connector includes a second housing and a plurality of signal and power terminals respectively mounted in the second housing. The cable set includes a signal cable and a plurality of power wires. The signal cable connects with the signal contacts of the first connector and terminated to the signal terminals of the second connector, while the power wires respectively connect with the power contacts of the first connector and terminated to the power terminals of the second connector. The first connector remains some power contacts free from any connection.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
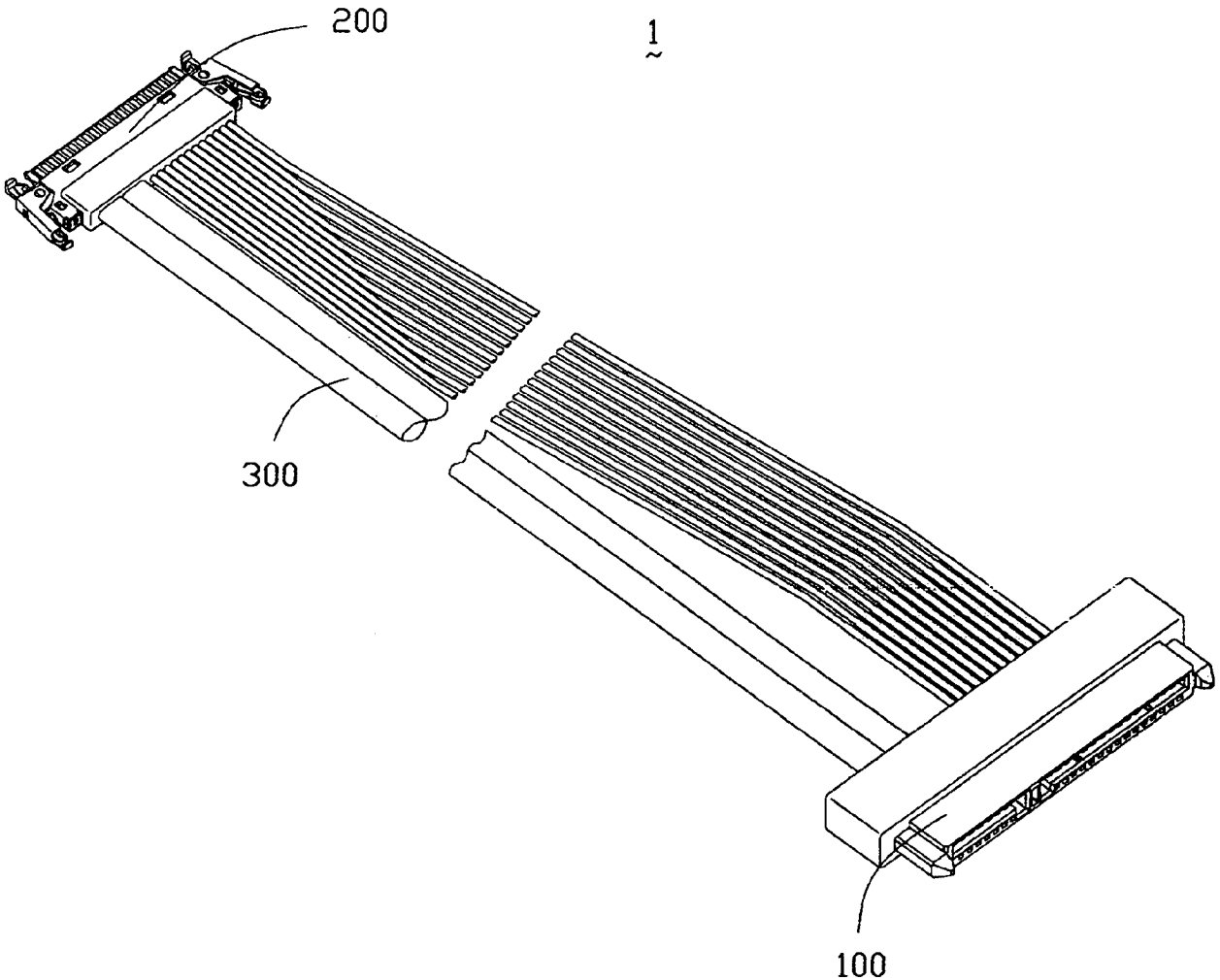
FIG. 1 is a perspective, assembled view of a cable assembly according to the present invention.
Figure 2:
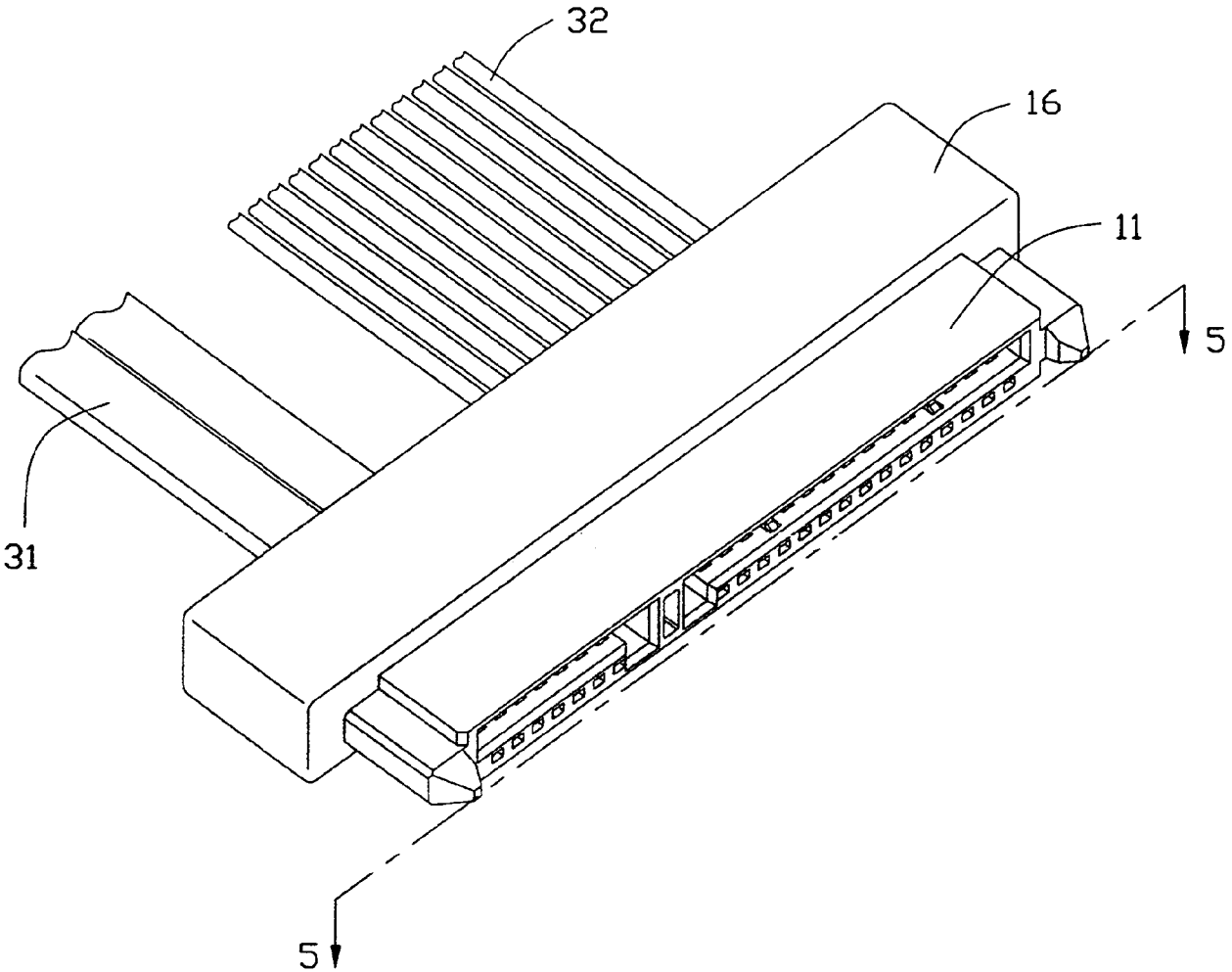
FIG. 2 is a perspective view of a serial ATA connector assembled with a cable set of the cable assembly.
Figure 3:
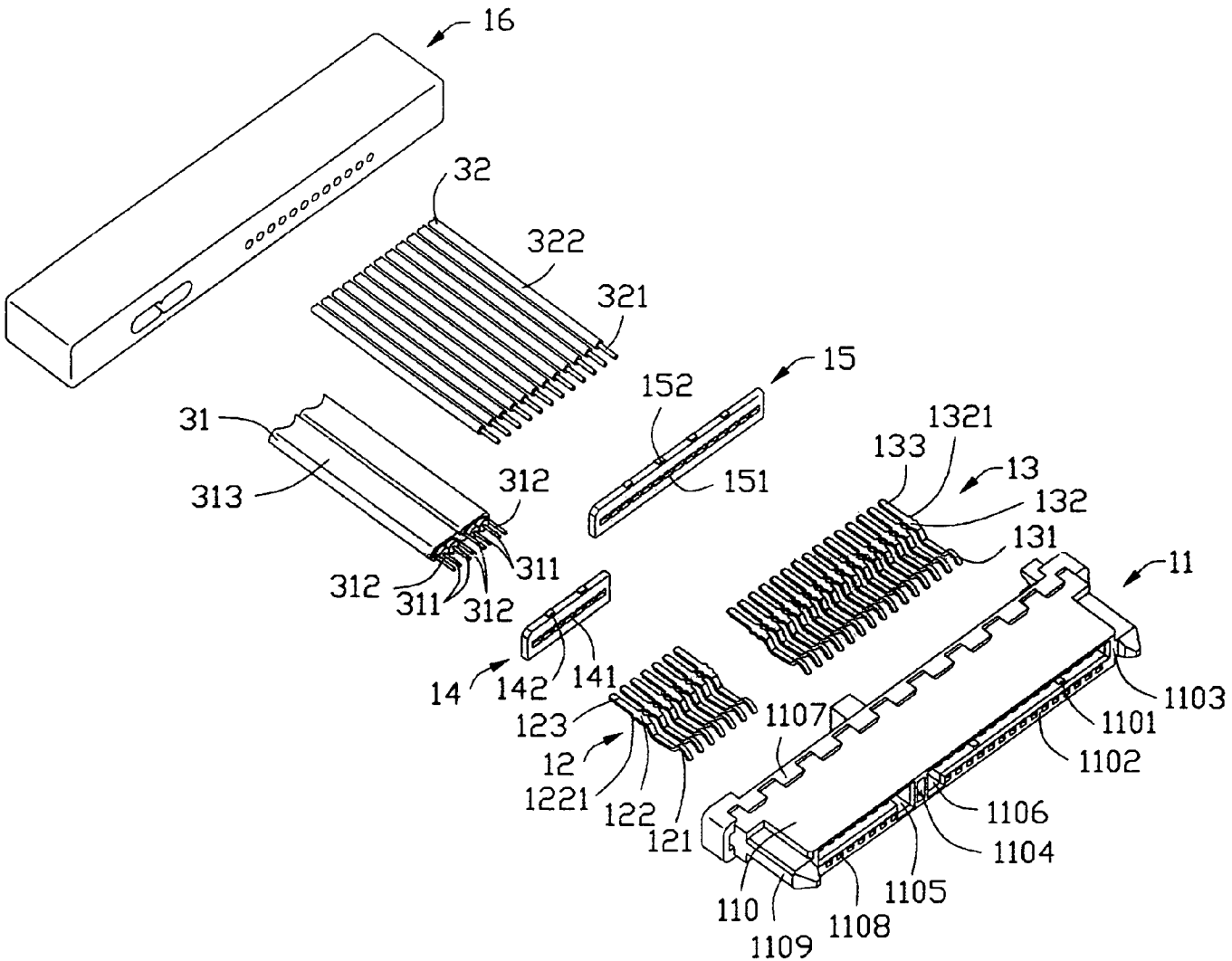
FIG. 3 is an exploded, perspective view of FIG. 2.
Figure 4:
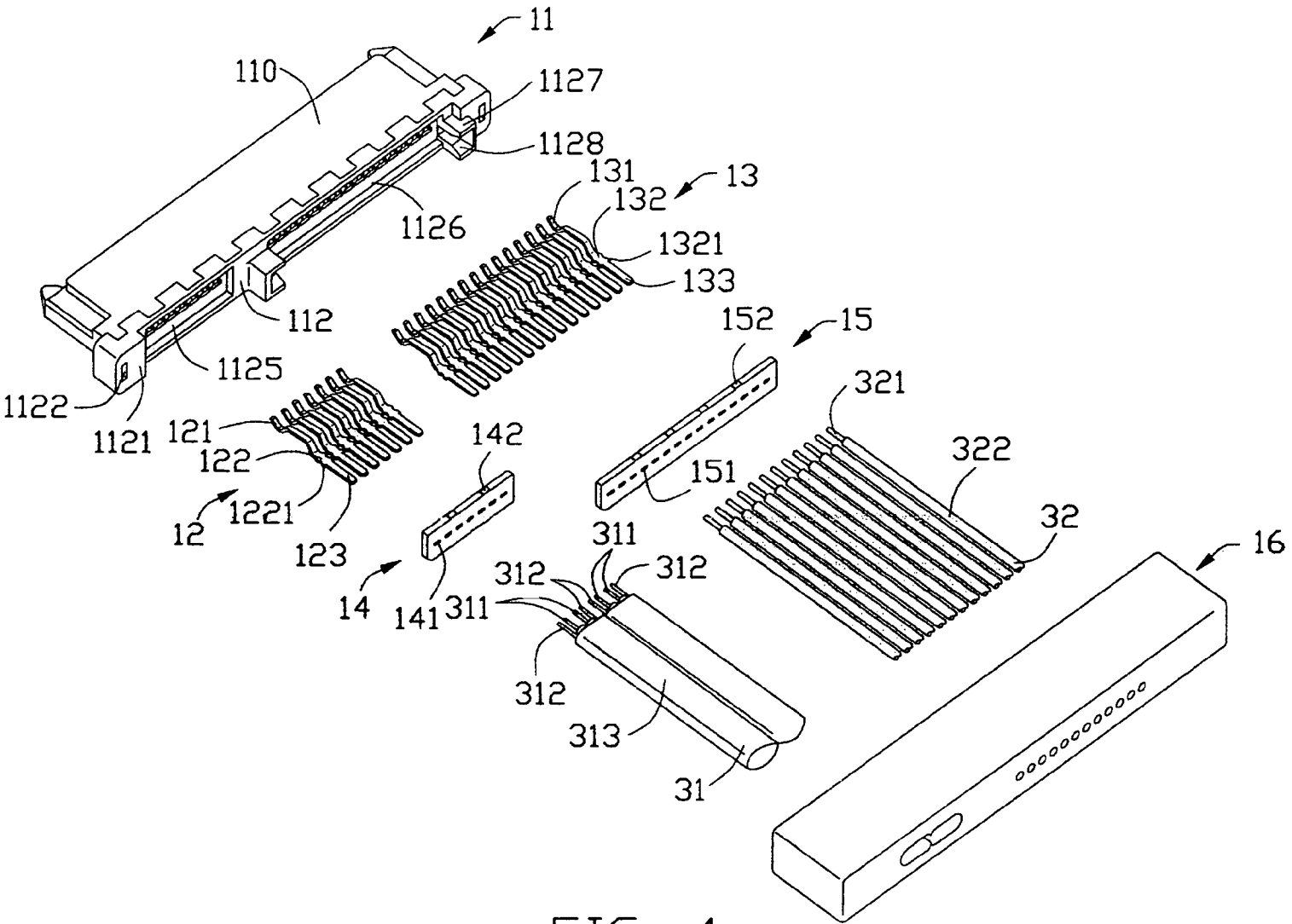
FIG. 4 is a view similar to FIG. 2, but taken from another aspect.
Figure 5:
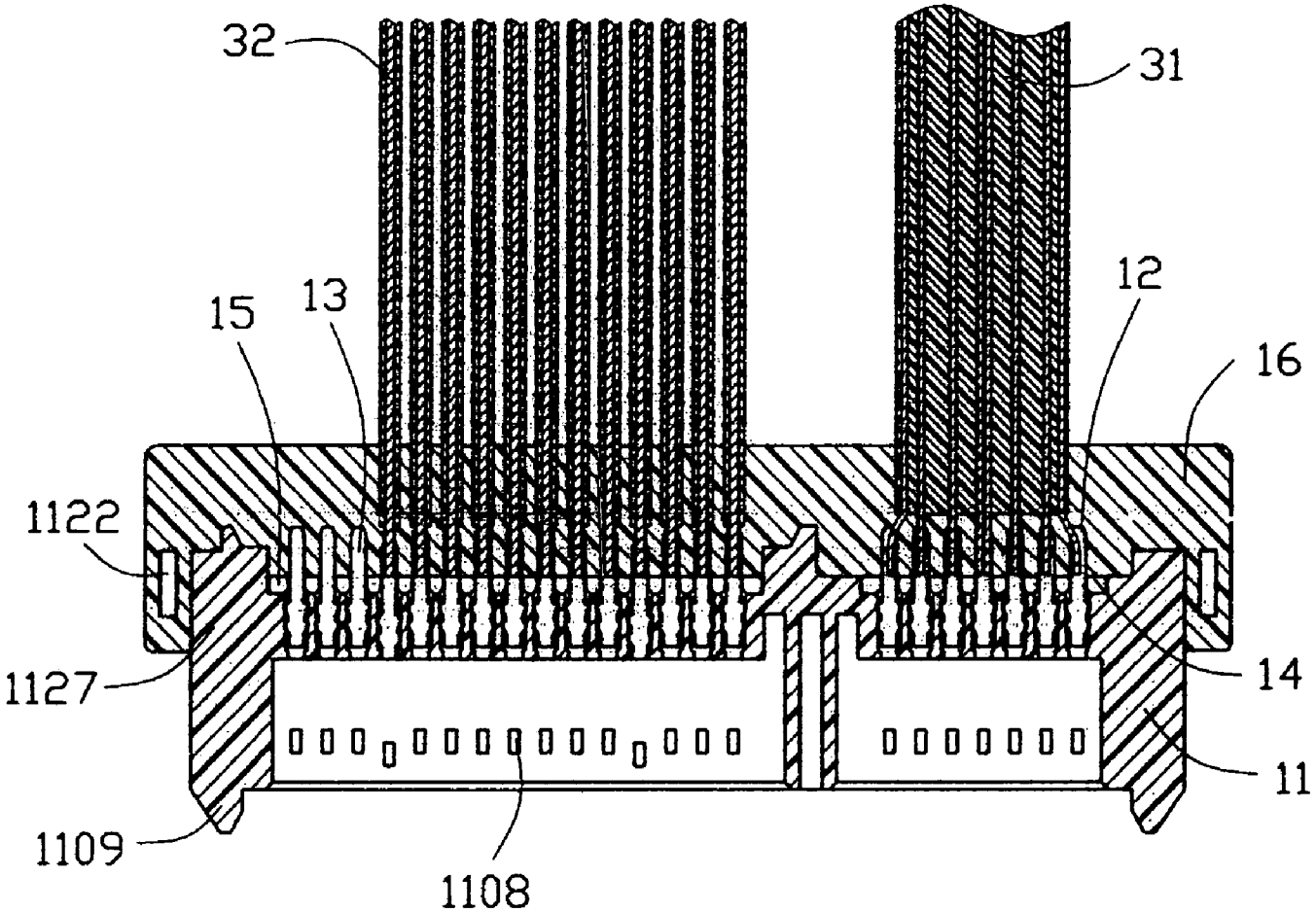
FIG. 5 is a cross-sectional view taken along line 5—5 of FIG. 2.

The present invention relates to a cable assembly 1 which is adapted for realizing electrical connection between a hard disk drive and a main printed circuit board (PCB) of a notebook computer (not shown). According to an exemplary embodiment of the present invention, shown in FIG. 1, the cable assembly 1 comprises a first Serial ATA connector 100 adapted for electrically connecting with a complementary plug (not shown) of the hard disk drive, a second connector 200 adapted for electrically connecting with a complementary connector (not shown) mounted on the main PCB, and a cable set 300 electrically connected with the first connector 100 and the second connector 200. In the preferred embodiment, the second connector 200 is a micro coaxial connector due to its low profile, stable electrical properties and excellent preventing EMI (Electromagnetic Interference) function.

Referring to FIGS. 2–5, the first connector 100 comprises an insulative first housing 11, a plurality of signal contacts 12 and power contacts 13, a signal spacer 14, a power spacer 15 and an insulative first cover 16 over-molded with a rear end of the first housing 11.

The first housing 11 is generally molded of plastic or polymer material and has an elongated base 110. The base 110 comprises an upper wall 1101, a lower wall 1102 opposite to the upper wall 1101, a pair of sidewalls 1103 connecting with the upper and the lower walls 1101, 1102, and an intermediate wall 1104 vertically extending between the sidewalls 1103 and connecting the upper and the lower walls 1101, 1102. The upper wall 1101, the lower wall 1102, the sidewalls 1103 and the intermediate wall 1104 together define an L-shaped signal mating port 1105 and an L-shaped power mating port 1106. The signal and power mating ports 1105, 1106 are arranged side by side and the signal mating port 1105 has a lengthwise dimension smaller than that of the power mating port 1106. The upper wall 1101 forms a plurality of spaced flat portions 1107 adjacent to a rear surface 112 (FIG. 4) of the base 110 to increase attach strength during over-molding of the first cover 16. The lower wall 1102 is thicker than the upper wall 1101 and defines a row of passageways 1108 extending therethrough along a front-to-back direction, wherein the passageways 1108 is divided into first passageways in the first mating port 1105 and second passageways in the second mating port 1106 by the intermediate wall 1104 for respectively receiving the signal contacts 12 and the power contacts 13. Additionally, the base 110 forms a pair of guiding posts 1109 from opposite lateral ends thereof and extending forwardly adjacent to the sidewalls 1103 for properly guiding the first connector 100 to mate with the complementary plug of the hard disk drive.

The first housing 11 forms a pair of flanges 1121 at opposite lateral ends of the base 110 and outwardly and rearwardly extending beyond the rear surface 112 of the first housing 11. Each flange 1121 defines a positioning hole 1122 therein. A signal recess 1125 and a power recess 1126 respectively extend forwardly from the rear surface 112 toward corresponding signal and power mating ports 1105, 1106 and communicate with the passageways 1108. A pair of wing portions 1127 extend rearwardly from the rear surface 112 and locate at opposite sides of the power recess 1120. Each wing portion 1127 defines a transverse U-shaped cutout 1128 facing to each other.

The signal contacts 12 and the power contacts 13 are stamped from a metal sheet and have the same configuration and dimensions. Each of the signal and power contacts 12, 13 comprises a curved contact portion 121, 131 at one free end thereof adapted to be received in a corresponding passageways 1108 of the first housing 11, a flat tail portion 123, 133 at the other free end thereof, and a retention portion 122, 132 connecting the contact portion 121, 131 and the tail portion 123, 133 and having a plurality of serrations 1221, 1321 symmetrically located at opposite sides thereof.

The signal spacer 14 and the power spacer 15 which respectively have a certain configuration and dimension for being nicely inserted into the signal recess 1125 and the power recess 1126 of the first housing 11, and can prevent plastic from entering into the passageways 1108 of the first housing 11 during over-molding of the first cover 16. The signal and power spacers 14, 15 respectively define a plurality of rectangular through holes 141, 151 for allowing the tail portions 123, 133 of the signal and power contacts 12, 13 to pass through. The signal and power spacers 14, 15 further respectively form a plurality of strengthen areas 142, 152 protruding from upper and lower surfaces thereof for interferentially working with inner surfaces of the signal and power recesses 1125, 1126 of the first housing 11.

Next, a structural description of the second connector 200 will now be described with reference to FIGS. 6–8. The second connector 200 comprises an insulative second housing 21, a contact set 22 having an insulative insert 23 and a plurality of terminals 24 for transmitting signals and power, a metallic shield 25, a pair of latch members 26, a pair of bolts 28 and an insulative second cover 27 partially over-molded with the shield 25.

The second housing 21 comprises an elongate base portion 211, a tongue portion 212 extending forwardly from middle region of the base portion 211, a termination portion 213 formed at a rear end of the base portion 211, and a pair of retention portions 214 respectively formed on lateral ends of the base portion 211. The base portion 211 and the tongue portion 212 together define a plurality of grooves 215 from the rear end of the base portion 211 to a front end of the tongue portion 212. The termination portion 213 comprises an elongated plate 2131 extending rearwardly from bottom edge of the base portion 211, a pair of receiving sections 2132 formed on lateral ends of the elongated plate 2131. Each receiving section 2132 defines a receiving channel 2133 in an inner side thereof. Each receiving section 2132 and a corresponding retention portion 214 define a gap 216 therebetween. Each of the retention portions 214 defines a depression 2141 in an outer wall thereof and a guiding portion 2142 extending forwardly therefrom. The guiding portion 2142 has an upright front end 2143 along a lengthwise direction and an upright lateral end 2144 extending from an inner side thereof along a lateral direction. The front end 2143 and the lateral end 2144 define an exit 2145 therebetween. The guiding portions 2142 are respectively spaced from the tongue portion 212 by a pair of cavities 217. Additionally, two pairs of first and second wedgy protrusions 2111 and 2134 are respectively formed on an upper surface of the base portion 211 and upper surfaces of the receiving sections 2132 fo the termination portion 213. Two pairs of first and second slits 2112, 2135 are respectively defined in opposite sides of the base portion 211 and the receiving sections 2132 of the termination portion 213 adjacent to corresponding protrusions 2134.

The insulative insert 23 of the contact set 22 is substantially U-shaped and defined by a pair of opposite side portions 231 and a transverse plate 232 jointed front ends of the side portions 231. The transverse plate 231 defines a plurality of alleyways 233 corresponding to the grooves 215 of the second housing 21. Each of the side portions 231 forms a guiding section 234 laterally and outwardly extending for entering into the receiving channel 2133 of the second housing 21 and a stopping section 235 vertically extending for bearing against corresponding rear end of the receiving section 2132 of the second housing 21 to prevent the contact set 22 from moving forwardly during over-molding of the second cover 27.

The terminals 24 are respectively received in the insulative insert 23 and have the same configuration and dimensions. Each of the terminals 24 comprises a retention section 242 at middle thereof, a mating section 241 extending rearwardly from the retention section 242, and a connecting section 243 extending forwardly from the retention section 242. Furthermore, each retention section 242 has a pair of spines 244 protruding outwardly for locking with the second housing 21.

The shield 25 has an upper plate 251 and a lower plate 252. The upper plate 251 and the lower plate 252 engage with each other and together define a space for receiving the second housing 21 therein. The upper plate 251 comprises a pair of side tabs 2511 extending downwardly from opposite sides thereof and a pair of upper flanges 2512 extending downwardly from a rear edge thereof. Each upper flange 2512 forms a resilient bulge 2513 thereon. A pair of front apertures 2514 and a pair of side apertures 2515 are defined at the upper shield 251 for respectively being fitted with the first and the second protrusions 2111, 2134 of the second housing 21. The lower plate 252 comprises two pairs of side bars 2521 extending upwardly to insert into the first and the second slits 2112, 2135 of the second housing 21 and a pair of lower flanges 2522 which define pinholes 2523 for receiving the resilient bulges 2513 of the upper flanges 2512. It is appreciated that the upper plate 251 and the lower plate 252 further respectively define two rows of round holes 2516, 2524 at rear regions thereof to increase over-mold attach strength during over-molding of the second cover 27.

The latch members 26 are respectively assembled to the retention portions 214 of the second housing 21 and each comprises a main body 261 and a hook portion 262 in a configuration of a claw extending rearwardly from the main body 261. The main body 261 comprises a top portion 2611, a bottom portion 2612 opposite to the top portion 2611 and a side portion 2613 connecting side edges of the top and bottom portions 2611, 2612. The top portion 2611, the bottom portion 2612, and the side portion 2613 together define a receiving space 2614. Each hook portion 262 extends through a corresponding cavity 217 of the second housing 21. Two retention holes 2615 are defined through the top and bottom portions 2611, 2612 of the main body 261. A spring tab 264 extends rearwardly from a rear end of the side portion 2613 and in a direction away from an inner surface of the side portion 2613. An engaging tab 263 is formed at the side portion 2613 and extends inwardly for engaging in the depression 2141 defined in the outer wall of the corresponding retention portion 214.

Referring to FIGS. 1–7, a structural description of the cable set 300 will be given hereinafter.

The cable set 300 comprises a signal cable 31 and a plurality of power wires 32. The signal cable 31 is a standard serial ATA cable and comprises two differential conductor pairs 311, two pairs of grounding conductors 312 each pair arranged at opposite sides of the differential conductor pair 311, and an insulative outer jacket 313 enclosing the differential conductor pairs 311 and the grounding conductors 312. The outer jacket 313 is stripped at opposite tip parts of the signal cable 31 so as to expose the differential conductor pairs 311 and the grounding conductors 312 for being electrically connected with corresponding tail portions 123 of the signal contacts 12 of the first connector 100 and corresponding connecting sections 243 of the terminals 24 of the second connector 200. The power wires 32 are arranged side by side and each comprises a center conductor 321 and an insulative outer layer 322 enclosing the center conductor 321. Similarly to the signal cable 31, the outer layers 322 are stripped at opposite tip parts of the power wires 32 so as to expose the center conductors 321 for being electrically connected with corresponding tail portions 133 of the power contacts 13 of the first connector 100 and corresponding connecting sections 243 of the terminals 24 of the second connector 200.

As mentioned above, assembly of the cable assembly 1 will now be described in greater detail. Please first referring to FIGS. 2–5, the signal contacts 12 and the power contacts 13 of the first connector 100 are respectively assembled in the first housing 11 from the rear surface 112 with the contact portions 121, 131 being inserted into the passageways 1108 and partially projecting into corresponding signal and power mating ports 1105, 1106, the serrations 1221, 1321 of the retention portions 122, 132 engaging with the first housing 11 to provide a secure retention force for the signal and power contacts 12, 13, and the tail portions 123, 133 extending beyond the rear surface 112. The signal spacer 14 and the power spacer 15 are respectively inserted into the signal recess 1125 and the power recess 1126. Correspondingly, the strengthen areas 142, 152 of the signal and power spacers 14, 15 interferentially work with inner surfaces of the first recess 1125 and second recess 1126, and the tail portions 123, 133 respectively extend through the rectangular holes 141, 151 of the signal and power spacers 14, 15.

Figure 6:
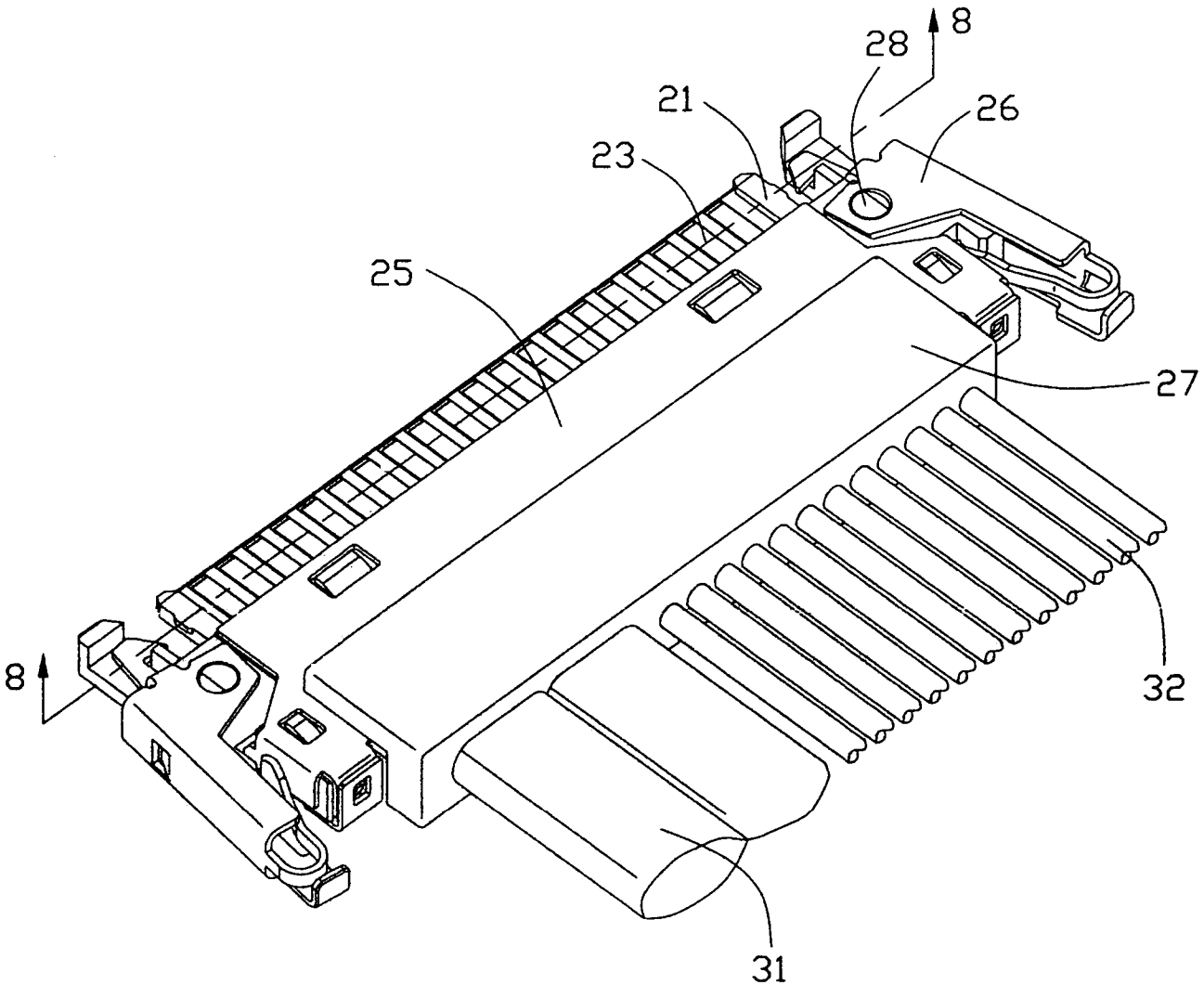
FIG. 6 is a perspective, assembled view of a cable connector assembled with the cable set.
Figure 7:
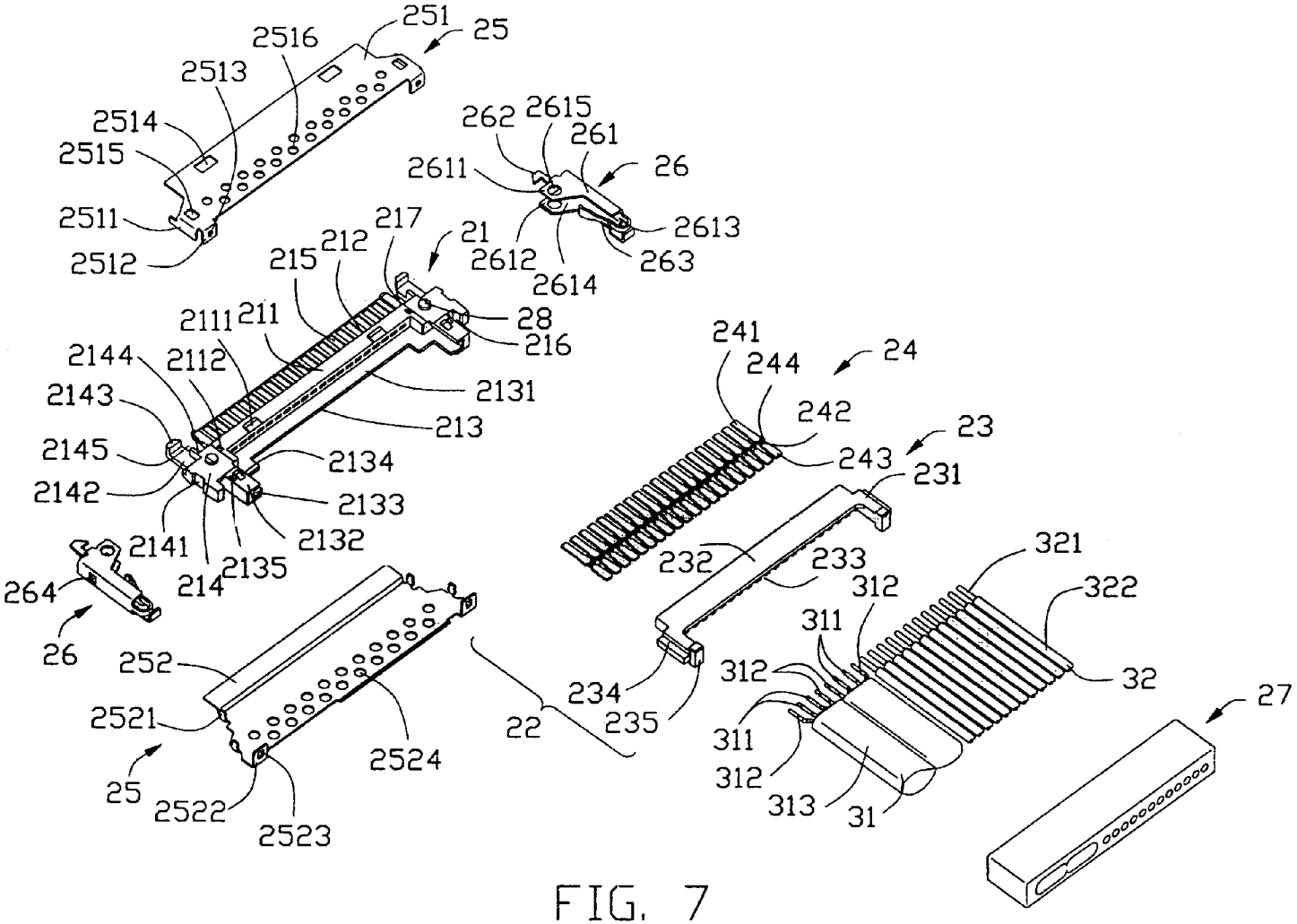
FIG. 7 is an exploded, perspective view of FIG. 6.
Figure 8:
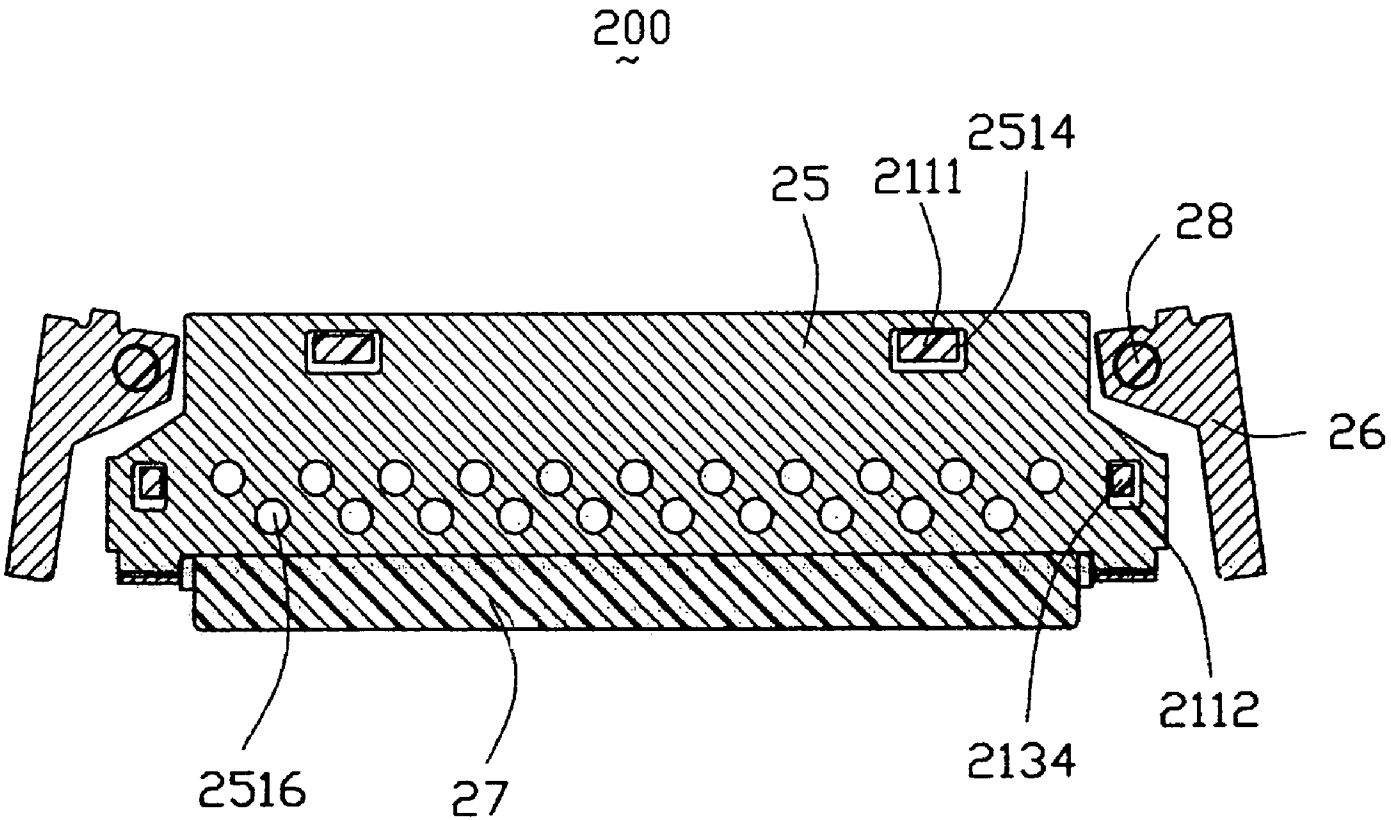
FIG. 8 is a cross-sectional view taken along line 8—8 of FIG. 6.

Then referring to FIGS. 6–8, the terminals 24 of the second connector 200 are respectively inserted into the alleyways 233 of the insert 23 with the connecting sections 243 partially received in the alleyways 233. The assembled insert 23 and the terminals 24 are assembled to the elongate plate 2131 of the rear portion 213 of the second housing 21 with the guiding sections 234 received in the receiving channels 2133 of the receiving sections 2132 and the stopping sections 235 bearing against corresponding rear end of the receiving sections 2132, and the retention sections 242 and the mating sections 241 of the terminals 24 extending into the grooves 215 of the tongue portion 212, wherein the spines 244 have an interferential fit with the second housing 21. Next, the shield 25 is assembled to the second housing 21. The upper plate 251 is assembled to the second housing 21 with the first and second protrusions 2111, 2134 fitted into the apertures 2514, 2515, and the side tabs 2511 engagingly received in the gaps 216. The lower plate 252 is assembled to the second housing 21 with the side bars 2521 inserted into the first and second slits 2112, 2135. The upper plate 251 and the lower plate 252 are fixed together by the resilient bulges 2513 on the upper flanges 2512 engaging with the pinholes 2523 defined in the lower flanges 2522. Next, the latch members 26 are assembled to the second housing 21 in a position where the body portions 261 warp the retention portions 214, and the hook portions 262 locate on the guiding portions 2142 with free end thereof extending into the exit 2145 of the guiding portions 2142. The bolts 28 are fitted into the retaining holes 2615 so that the latch members 26 are pivotally mounted on the second housing 21. The spring tabs 263 extend into the gaps 216 and resiliently abut against the side tabs 2511 of the upper plate 251. The engaging tabs 264 are engagingly received in the depressions 2141, respectively.

Then, the cable set 300 realizes electrical connection between the first connector 100 and the second connector 200. Please pay more attention to FIG. 5, after the solder connection among the cable set 300 and the first and second connectors 100, 200, the first connector 100 still remains three power contacts 13 free from any connection. These three power contacts 13 are used for other special applications.

At length, the first cover 16 is over-molded with a rear end of the first housing 11 and encircling joints between the signal and power contacts 12, 13 and the cable set 300 to provide a cable strain relief. The second cover 27 has an elongated base over-molded with a part of the shield and encircling joints between the terminals 22 and the cable set 200 to provide a cable strain relief. It is appreciated that the first housing 11 forms the spaced flat portions 1107, the upper and lower plate 251, 252 respectively define a plurality of round holes 2516, 2524 to increase over-mold attach strength during over-molding of the first cover 16 and the second cover 27.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a first connector comprising a first insulative housing, a plurality of signal and power contacts, a pair of spacers and a first cover over-molded with a rear end of the first housing, the first housing comprising an elongated base defining a pair of side by side mating ports along a front-to-back direction and a pair of recesses extending forwardly from a rear surface thereof, the signal and power contacts respectively received in the mating ports and each having a straight tail portion extending rearwardly beyond the rear surface, the spacers respectively received in the recesses and veiling the rear surface except defining a plurality of through holes which allows the tail portions of the signal and power contacts to snugly extend therethrough;

a second connector comprising a second insulative housing, a plurality of signal and power terminals and a shield partially enclosing die second housing, the second housing comprising a base portion, a tongue portion perpendicularly extending from the base portion, the base portion and the tongue portion together define a plurality of grooves from a rear end of the base portion to a front end of the tongue portion for receiving the signal and power terminals; and a cable set comprising a signal cable and a plurality of power wires arranged side by side, the signal cable electrically connecting with the signal contacts of the first connector and terminated to the signal terminals of the second connector, the power wires electrically connecting with the power contacts of the first connector and terminated to the power terminals of the second connector; wherein the first connector remains some power contacts free from any connection.

2. The cable assembly as claimed in claim 1, wherein the first housing forms a plurality of spaced flat portions extending adjacent to the rear surface of the base to increase over-mold attach strength dating over-molding the first cover.

3. The cable assembly as claimed in claim 1, wherein the second connector further comprises a second cover having an elongated body over-molding a part of the shield end encircling joins between the signal and power terminals and the cable set to provide a cable strain relief.

4. The cable assembly as claimed in claim 3, wherein the shield defines a plurality of holes at rear region thereof to increase over-mold attach strength during over-molding of the second cover.

5. The cable assembly as claimed in claim 4, wherein the shield comprises an upper plate and a lower plate engaging with the upper plate.

6. The cable assembly as claimed in claim 1, wherein the second connector comprises an insulative insert defined by a pair of opposite side portions and a transverse plate jointed front ends of the side portions, the transverse plate defining a plurality of alleyways according to the grooves of the second housing to receive rear ends of the terminals.

7. The cable assembly as claimed in claim 6, wherein the second housing bas a termination portion at a rear end of the base portion, and wherein the insert with the terminals is assembled to the second housing from the termination portion.

8. The cable assembly as claimed in claim 7, wherein the termination portion has an elongated plate and a pair of receiving sections formed on lateral ends of the elongated plate, each receiving section defining a receiving channel in an inner side thereof, and wherein each side portion of the insert forms a guiding section to be received in the receiving channel and a stopping section to abut against rear end of the receiving section.

9. The cable assembly as claimed in claim 7, wherein the second housing further has a pair of retention portions formed on lateral ends of the base portion, and wherein the second connector further comprises a pair of latch members assembled to the retention portions.

10. A cable connector assembly comprising:

an insulative housing having a base portion and a tongue portion perpendicularly extending from the base portion, the base portion and the tongue portion together define a plurality of grooves therethrough:

a plurality of terminals received in the grooves for transmitting signals and power and each having a mating section retained in the tongue portion and a connecting section extending beyond rear end of the base portion;

a cable set arranged side by side to electrically connect with the connecting sections of corresponding terminals;

a metallic shield partially enclosing the housing; and a cover having an elongated body overlapping a part of the shield and encircling joints between the terminals and the cable set to provide a cable strain relief.

11. The cable connector assembly as claimed in claim 10, wherein the shield defines a plurality of holes at rear region thereof to increase over-mold attach strength during aver-molding of the cover.

12. The cable connector assembly as claimed in claim 11, wherein the shield comprises an upper plate and a lower plate, the upper plate having a pair of upper flanges each forming a resilient bulge thereon, and wherein the lower plate has a pair of lower flanges each defining a pinhole for receiving the resilient bulge to joint the upper and lower plate together.

13. The cable connector assembly as claimed in claim 12, wherein the upper plate defines a plurality of apertures, and wherein the housing forms a plurality of protrusions hit engagingly received in the apertures.

14. The cable connector assembly as claimed in claim 12, wherein the lower plate forms a plurality of side bars extending upwardly from lateral ends thereof, and wherein the housing defines a plurality of slits for engagingly receiving the side bars.

15. The cable connector assembly as claimed in claim 10, wherein the housing has a termination portion formed at a rear end of the base portion, the termination portion having an elongated plate and a pair of receiving sections fanned on lateral ends of the elongated plate, and wherein each receiving section and a corresponding retention portion define a gap therebetween.

16. The cable connector assembly as claimed in claim 15, wherein the housing has a pair of retention portions respectively formed on lateral ends of the base portion, and wherein each retention portion has a depression recessed in an outer wall thereof and a guiding portion extending with the tongue portion.

17. The cable assembly as claimed in claim 16, wherein the cable connector further comprises a pair of latch members pivotally mounted on the housing, each latch member having a main body wrapping the retention portion, an engaging tab engagingly received in the depression, a hook portion in a configuration of a claw located on die guiding portion, and a spring tab extending into the gap.

18. A cable connector assembly comprising:

a Serial Advanced Technology Attachment (ATA) interface connector defining a unitary insulative first housing, a plurality of first signal contacts and first power contacts commonly disposed in the first housing under an aligned manner with each other along a longitudinal direction of the first housing;

a non-Serial ATA interface connector located opposite to said Serial ATA interface connector defining a unitary insulative second housing with unitary interface, a plurality of second signal contacts and second power contacts commonly disposed in the second housing under an aligned manner with each other along a longitudinal direction of the second housing; and a cable set interconnected between said Serial ATA interface connector and said non-Serial ATA interface connector, said cable set including a plurality of signal wires connected between the first signal contacts and the second signal contacts, respectively, and a plurality of power wires connected between the first power contacts and the second power contacts, respectively; wherein some of the first power contacts are free from said cable set while all of the second power contacts are connected to the corresponding power wires, respectively.

19. The cable connector assembly as claimed in claim 18, wherein said some of the first power contacts and said first signal contacts are respectively located on two opposite sides of the rest of the first power contacts in said longitudinal direction thereof.

20. The cable connector assembly as claimed in claim 18, wherein said non-Serial ATA interface connector is equipped with a pair of latch members at two opposite ends of the second housing along the corresponding longitudinal direction thereof.

* * * * *